US011117772B2

(12) United States Patent
Seki

(10) Patent No.: US 11,117,772 B2
(45) Date of Patent: Sep. 14, 2021

(54) MEDIUM EJECTION APPARATUS FOR EJECTING MEDIA TO ALIGN THE POSITIONS OF THE MEDIA EJECTED ONTO AN EJECTION TRAY

(71) Applicant: PFU LIMITED, Kahoku (JP)

(72) Inventor: Kazuhito Seki, Kahoku (JP)

(73) Assignee: PFU LIMITED, Kahoku (JP)

( * ) Notice: Subject to any disclaimer, the term of this patent is extended or adjusted under 35 U.S.C. 154(b) by 259 days.

(21) Appl. No.: 16/433,976

(22) Filed: Jun. 6, 2019

(65) Prior Publication Data

US 2020/0255252 A1 Aug. 13, 2020

(30) Foreign Application Priority Data

Feb. 7, 2019 (JP) ..... JP2019-020852

(51) Int. Cl.

| | |
|---|---|
| ***B65H 29/14*** | (2006.01) |
| ***B65H 43/00*** | (2006.01) |
| ***B65H 29/12*** | (2006.01) |
| ***B65H 43/08*** | (2006.01) |
| *B65H 31/02* | (2006.01) |

(52) U.S. Cl.

CPC ..... *B65H 29/14* (2013.01); *B65H 29/125* (2013.01); *B65H 43/00* (2013.01); *B65H 43/08* (2013.01); *B65H 31/02* (2013.01); *B65H 2301/4212* (2013.01); *B65H 2405/11151* (2013.01); *B65H 2511/11* (2013.01); *B65H 2513/108* (2013.01); *B65H 2513/53* (2013.01); *B65H 2553/414* (2013.01); *B65H 2701/1311* (2013.01); *B65H 2701/1313* (2013.01); *B65H 2801/06* (2013.01)

(58) Field of Classification Search

CPC ..... B65H 29/14; B65H 43/00; B65H 2511/11

See application file for complete search history.

(56) References Cited

U.S. PATENT DOCUMENTS

| | | | | |
|---|---|---|---|---|
| 5,915,158 | A | 6/1999 | Minagawa et al. | |
| 7,828,279 | B2 * | 11/2010 | Hammen | H04N 1/00631 271/3.14 |
| 8,146,909 | B2 * | 4/2012 | Kuno | B65H 31/3081 271/3.02 |
| 8,408,544 | B2 * | 4/2013 | Reinke | B65H 7/20 271/288 |
| 10,001,738 | B2 * | 6/2018 | Mori | G03G 15/50 |
| 2007/0228649 | A1 * | 10/2007 | Mizutani | B65H 29/14 271/314 |
| 2009/0060614 | A1 * | 3/2009 | Hirokawa | G03G 15/6573 399/397 |

FOREIGN PATENT DOCUMENTS

| | | | |
|---|---|---|---|
| JP | 9-185188 | A | 7/1997 |
| JP | 2010-116235 | A | 5/2010 |
| JP | 2016-160063 | A | 9/2016 |

* cited by examiner

*Primary Examiner* — Jeremy R Severson

(74) *Attorney, Agent, or Firm* — Lewis Roca Rothgerber Christie LLP

(57) ABSTRACT

A medium ejection apparatus includes an ejection roller pair configured to eject a medium, a driving device configured to rotate at least one roller of the ejection roller pair, a processor for detecting a size of the medium, and controlling the driving device to increase a rotation speed of the at least one roller to be higher than a previous rotation speed, from a predetermined timing after a rear edge of the medium passes through a nip position of the ejection roller pair. The processor changes the predetermined timing in accordance with the size of the medium.

8 Claims, 13 Drawing Sheets

MEDIUM EJECTION APPARATUS FOR EJECTING MEDIA TO ALIGN THE POSITIONS OF THE MEDIA EJECTED ONTO AN EJECTION TRAY

CROSS-REFERENCE TO RELATED APPLICATIONS

This application is based upon and claims the benefit of priority of prior Japanese Patent Application No. 2019-020852, filed on Feb. 7, 2019, the entire contents of which are incorporated herein by reference.

TECHNICAL FIELD

Embodiments discussed in the present specification relate to ejecting a medium.

BACKGROUND

Generally, in a medium ejection apparatus such as a scanner which captures an image of a medium such as a document while conveying the medium and ejects the medium, media having different sizes may be conveyed. In this case, it is desired to align the positions of the media ejected onto an ejection tray, so that a user can easily jog the ejected media.

A sheet feed apparatus has been disclosed which detects an abnormal shape of a sheet fed into the apparatus and controls the ejection speed of the sheet, based on the detection result (Japanese Unexamined Patent Publication (Kokai) No. 2010-116235).

A sheet material conveyance apparatus has been disclosed which, when it is determined that the length of a sheet material is larger than a predetermined length, reduces the conveyance speed of the sheet material from a reference speed to a speed set in advance to convey a long sheet material (Japanese Unexamined Patent Publication (Kokai) No. 2016-160063).

An automatic document feed apparatus has been disclosed which, when the length of a document is less than that of a previous document, returns the document to an exposure reference position on a platen and stops the document, as the leading edge of the previous document is nipped by a document ejection means after the document passes through the exposure reference position (Japanese Unexamined Patent Publication (Kokai) No. H09-185188).

SUMMARY

In the medium ejection apparatus, when media having different sizes are conveyed, it is desired to eject the media to more suitably align the positions of the media ejected onto the ejection tray.

It is an object of this embodiment to provide a medium ejection apparatus, a control method, and a computer-readable, non-transitory medium storing a computer program which can eject media to more suitably align the positions of the media ejected onto an ejection tray.

According to an aspect of the apparatus, there is provided a medium ejection apparatus. The medium ejection apparatus includes an ejection roller pair configured to eject a medium, a driving device configured to rotate at least one roller of the ejection roller pair, a processor for detecting a size of the medium, and controlling the driving device to increase a rotation speed of the at least one roller to be higher than a previous rotation speed, from a predetermined timing after a rear edge of the medium passes through a nip position of the ejection roller pair. The processor changes the predetermined timing in accordance with the size of the medium.

According to an aspect of the method, there is provided a control method for a medium ejection apparatus including an ejection roller pair configured to eject a medium, and a driving device configured to rotate at least one roller of the ejection roller pair. The method includes detecting a size of the medium, controlling the driving device to increase a rotation speed of the at least one roller to be higher than a previous rotation speed, from a predetermined timing after a rear edge of the medium passes through a nip position of the ejection roller pair, and changing the predetermined timing in accordance with the size of the medium.

According to an aspect of the computer-readable, non-transitory medium storing a computer program, the computer program causes a medium ejection apparatus including an ejection roller pair configured to eject a medium, and a driving device configured to rotate at least one roller of the ejection roller pair, to execute a process. The process includes detecting a size of the medium, controlling the driving device to increase a rotation speed of the at least one roller to be higher than a previous rotation speed, from a predetermined timing after a rear edge of the medium passes through a nip position of the ejection roller pair, and changing the predetermined timing in accordance with the size of the medium.

The object and advantages of the invention will be realized and attained by means of the elements and combinations particularly pointed out in the claims. It is to be understood that both the foregoing general description and the following detailed description are exemplary and explanatory, and are not restrictive of the invention, as claimed.

DESCRIPTION OF EMBODIMENTS

Hereinafter, an image processing apparatus, a control method and a computer-readable, non-transitory medium storing a computer program according to an embodiment, will be described with reference to the drawings. However, it should be noted that the technical scope of the invention is not limited to these embodiments, and extends to the inventions described in the claims and their equivalents.

Figure 1:
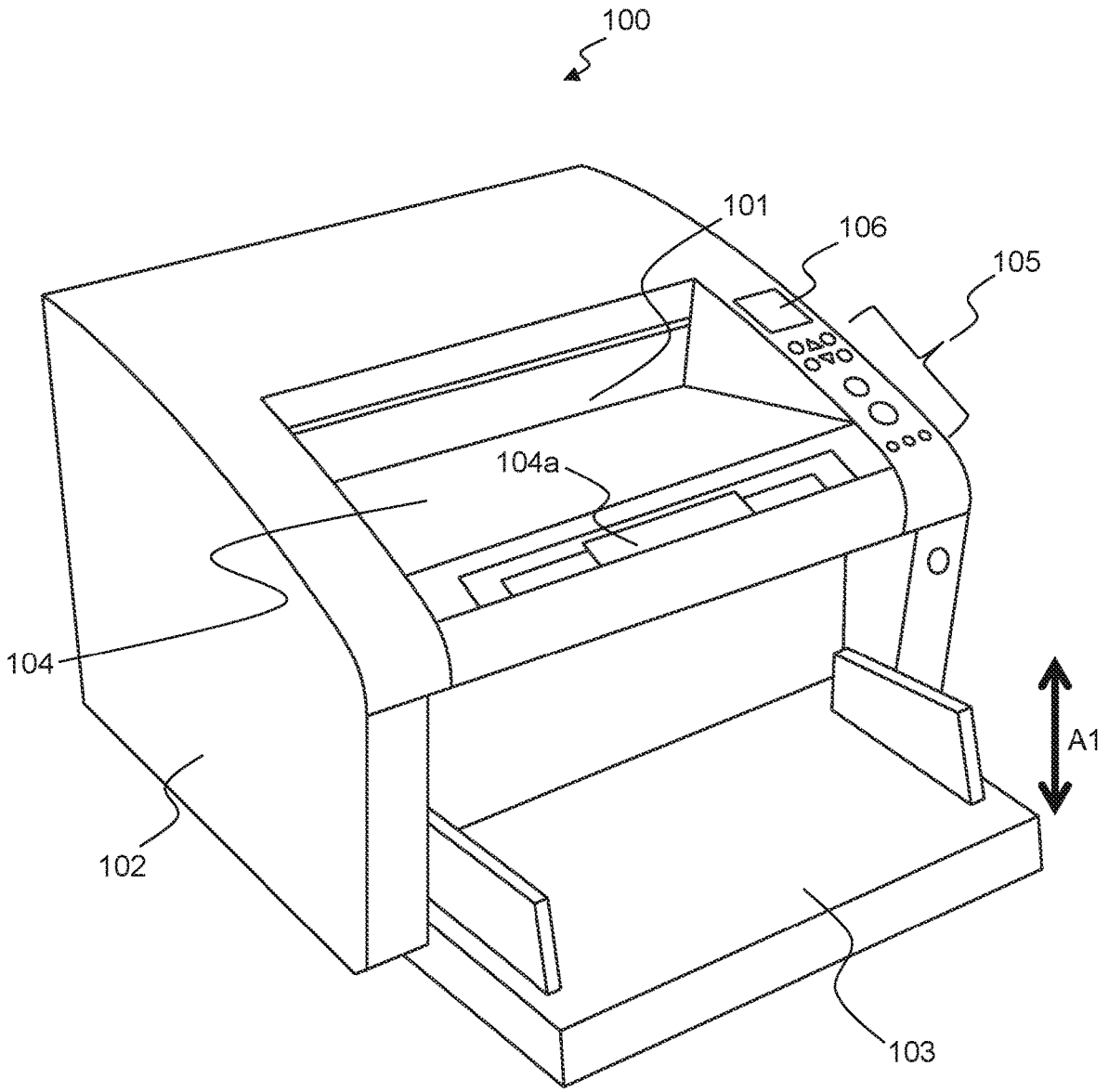
FIG. 1 is a perspective view illustrating a medium ejection apparatus 100.

FIG. 1 is a perspective view illustrating a medium ejection apparatus 100 implemented as an image scanner. The medium ejection apparatus 100 conveys a medium implemented as a document and captures an image of the medium. Examples of the medium include paper, cardboard, and a card. The medium ejection apparatus 100 may also be implemented as, e.g., a facsimile machine, a copying machine, or a multifunction peripheral (MFP) printer. The medium to be conveyed may be implemented not as a document but as, e.g., an object to be printed, and the medium ejection apparatus 100 may also be implemented as, e.g., a printer.

The medium ejection apparatus 100 includes, e.g., an upper housing 101, a lower housing 102, a medium tray 103, an ejection tray 104, an operation device 105, and a display device 106.

The upper housing 101 is disposed on the upper side of the medium ejection apparatus 100, and engages with the lower housing 102 by a hinge to be openable and closable upon a medium jam, in cleaning the interior of the medium ejection apparatus 100, etc.

The medium tray 103 engages with the lower housing 102 so that the medium to be conveyed can be mounted on the medium tray 103. The medium tray 103 is provided on the side surface of the lower housing 102 on the medium supply side to be movable in a nearly vertical direction A1. The medium tray 103 is disposed at the position of a lower end to easily mount a medium on the medium tray 103 when the medium is not conveyed, and lifts to a height nearly equal to that of a medium conveyance path to feed a medium mounted on the medium tray 103 when the medium is conveyed. The ejection tray 104 is formed on the upper housing 101 so that it can hold the ejected medium. The ejection tray 104 includes an auxiliary ejection tray 104*a* which is pulled out of the ejection tray 104 as appropriate and holds the medium.

The operation device 105 includes an input device such as a button and an interface circuit which acquires signals from the input device, and accepts an input operation by a user and outputs an operation signal according to the input operation of the user. The display device 106 includes a display containing, e.g., liquid crystal or organic electroluminescence (EL) and an interface circuit which outputs image data to the display, and displays the image data on the display.

Figure 2:
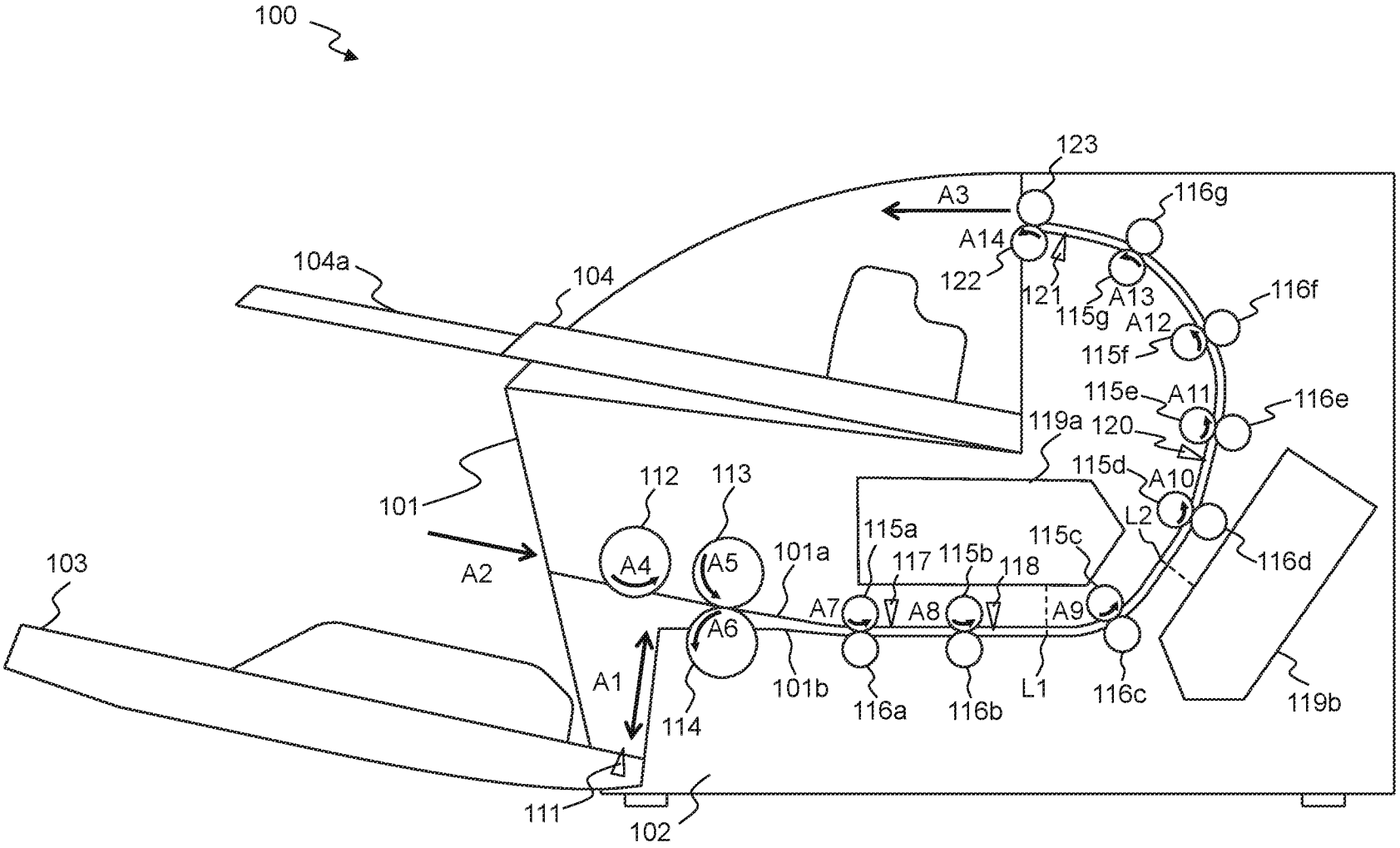
FIG. 2 is a view for explaining a conveyance path inside the medium ejection apparatus 100.

FIG. 2 is a view for illustrating a conveyance path inside the medium ejection apparatus 100.

The conveyance path inside the medium ejection apparatus 100 includes, e.g., a first sensor 111, a pick roller 112, a feed roller 113, a brake roller 114, first to seventh conveyance rollers 115*a* to 115*g*, first to seventh driven rollers 116*a* to 116*g*, a second sensor 117, a third sensor 118, a first imaging device 119*a*, a second imaging device 119*b*, a fourth sensor 120, a fifth sensor 121, a lower ejection roller 122, and an upper ejection roller 123.

Each of the numbers of pick rollers 112, feed rollers 113, brake rollers 114, first to seventh conveyance rollers 115*a* to 115*g*, first to seventh driven rollers 116*a* to 116*g*, lower ejection rollers 122, and/or upper ejection rollers 123 is not limited to one, and may be plural. In this case, the pluralities of pick rollers 112, feed rollers 113, brake rollers 114, first to seventh conveyance rollers 115*a* to 115*g*, and/or first to seventh driven rollers 116*a* to 116*g* are respectively arranged with spacings between them in a direction perpendicular to a medium conveyance direction A2. Similarly, the pluralities of lower ejection rollers 122 and/or upper ejection rollers 123 are also respectively arranged with spacings between them in a direction perpendicular to the medium conveyance direction A2. The lower ejection roller 122 and the upper ejection roller 123 in combination will sometimes be referred to as an ejection roller pair hereinafter.

The surface, facing the lower housing 102, of the upper housing 101 forms a first guide 101*a* in the medium conveyance path, and the surface, facing the upper housing 101, of the lower housing 102 forms a second guide 102*a* in the medium conveyance path. In FIG. 2, an arrow A2 indicates a medium conveyance direction, and an arrow A3 indicates a medium ejection direction. Hereinafter, upstream refers to upstream of the medium conveyance direction A2 or the medium ejection direction A3; downstream refers to downstream of the medium conveyance direction A2 or the medium ejection direction A3.

The first sensor 111 is disposed on the medium tray 103, i.e., upstream of the feed roller 113 and the brake roller 114, and detects the mount state of a medium on the medium tray 103. The first sensor 111 determines whether a medium is mounted on the medium tray 103, using a contact detection sensor which supplies a certain current when the medium is in contact or is not in contact. The first sensor 111 generates and outputs a first detection signal having a value which changes between the state in which a medium is mounted on the medium tray 103 and that in which no medium is mounted on the medium tray 103.

The pick roller 112 is provided in the upper housing 101, and comes into contact with the medium mounted on the medium tray 103 lifted to a height nearly equal to that of the medium conveyance path to feed this medium to the downstream side. The feed roller 113 is provided downstream of the pick roller 112 in the upper housing 101 and further feeds, to the downstream side, the medium fed by the pick roller 112. The brake roller 114 is disposed in the lower housing 102 to face the feed roller 113. The feed roller 113 and the brake roller 114 perform a medium separation operation, in which they separate the media one by one and feed them. The first to seventh conveyance rollers 115*a* to 115*g* and the first to seventh driven rollers 116*a* to 116*g* are provided upstream of the lower ejection roller 122 and the upper ejection roller 123 in the medium ejection direction A3, and convey, to the downstream side, the medium fed by the feed roller 113.

The second sensor 117 is disposed downstream of the feed roller 113 and the brake roller 114 and upstream of an imaging position L1 of the first imaging device 119*a* and an imaging position L2 of the second imaging device 119*b*, and detects the medium conveyed to its position. The second sensor 117 includes a light-emitting device and a light-receiving device provided on one side (upper housing 101) of the medium conveyance path, and a reflecting member such as a mirror provided at the position (lower housing 102) opposite to the light-emitting device and the light-receiving device across the medium conveyance path. The light-emitting device is implemented as, e.g., an LED and emits light to the medium conveyance path. The light-receiving device receives light emitted by the light-emitting device and reflected by the reflecting member. When a medium is present opposite to the second sensor 117, since light emitted by the light-emitting device is shielded by the medium, the light-receiving device does not detect the light emitted by the light-emitting device. The light-receiving device generates and outputs a second detection signal having a value which changes between the state in which a medium is present at the position of the second sensor 117 and that in which a medium is absent at this position, based on the intensity of the received light.

A light-emitting device and a light-receiving device may be provided on opposite sides of the medium conveyance path. The second sensor 117 may detect the presence of a medium, using, e.g., a contact detection sensor which supplies a certain current when the medium is in contact or is not in contact.

The third sensor 118 is disposed downstream of the second sensor 117 and upstream of an imaging position L1 of the first imaging device 119*a* and an imaging position L2 of the second imaging device 119*b*, and detects the medium conveyed to its position. The third sensor 118 has the same configuration as that of the second sensor 117, and generates and outputs a third detection signal having a value which changes between the state in which a medium is present at the position of the third sensor 118 and that in which a medium is absent at this position.

The first imaging device 119*a* includes a reduction optical system image sensor equipped with image sensing elements implemented as charge coupled devices (CCDs) linearly arrayed in the main scanning direction. The first imaging device 119*a* further includes a light source which emits light, a lens which forms images on the image sensing elements, and an A/D converter which amplifies and analog/digital (A/D)-converts electrical signals output from the image sensing elements. In the first imaging device 119*a*, the image sensor captures an image of the front-surface of a medium to be conveyed to generate and output an analog image signal, and the A/D converter A/D-converts the analog image signal to generate and output a digital input image.

The second imaging device 119*b* includes a reduction optical system image sensor equipped with image sensing elements implemented as CCDs linearly arrayed in the main scanning direction. The second imaging device 119*b* further includes a light source which emits light, a lens which forms images on the image sensing elements, and an A/D converter which amplifies and A/D-converts electrical signals output from the image sensing elements. In the second imaging device 119*b*, the image sensor captures an image of the back-surface of a medium to be conveyed to generate and output an analog image signal, and the A/D converter A/D-converts the analog image signal to generate and output a digital input image.

It should be noted that only one of the first imaging device 119*a* and the second imaging device 119*b* may be provided to read only one of the surfaces of a medium. Alternatively, it may possible to use a CIS (Contact Image Sensor) of the same-size optical system type having image sensing elements based on CMOS (Complementary Metal Oxide Semiconductor) instead of the CCD. Hereinafter, the first imaging device 119*a* and the second imaging device 119*b* may be collectively referred to as the imaging device 119.

The fourth sensor 120 is disposed downstream of the imaging position L1 of the first imaging device 119*a* and the imaging position L2 of the second imaging device 119*b* and upstream of the lower ejection roller 122 and the upper ejection roller 123, and detects the medium conveyed to its position. The fourth sensor 120 has the same configuration as that of the second sensor 117, and generates and outputs a fourth detection signal having a value which changes between the state in which a medium is present at the position of the fourth sensor 120 and that in which a medium is absent at this position.

The fifth sensor 121 is disposed downstream of the fourth sensor 120 and upstream of the lower ejection roller 122 and the upper ejection roller 123, and detects the medium conveyed to its position. The fifth sensor 121 has the same configuration as that of the second sensor 117, and generates and outputs a fifth detection signal having a value which changes between the state in which a medium is present at the position of the fifth sensor 121 and that in which a medium is absent at this position.

When the pick roller 112 and the feed roller 114 rotate, respectively, in the medium feeding direction A4, A5, the medium mounted on the medium tray 103 is conveyed between the first guide 101*a* and the second guide 102*a* toward the medium conveyance direction A2. On the other hand, when multiple media are stacked on the medium tray 103, the break roller 114 rotates in the opposite direction of the medium conveyance direction A2, so that only the medium in contact with the feed roller 114 is separated from the media mounted on the medium tray 103.

The lower ejection roller 122 is an example of a lower roller, and the upper ejection roller 123 is an example of an upper roller. The ejection roller pair ejects the conveyed medium onto the ejection tray 104.

The medium is fed to the imaging position L1 of the first imaging device 119*a*, upon rotation of the first and second conveyance rollers 115*a* and 115*b* in the directions indicated by arrows A7 and A8, respectively, while being guided by the first guide 101*a* and the second guide 102*a*. After that, the medium is fed between the third conveyance roller 115*c* and the third driven roller 116*c*, and further fed to the imaging position L2 of the second imaging device 119*b* upon rotation of the third conveyance roller 115*c* in the direction indicated by an arrow A9. The medium read by each imaging device 119 is ejected onto the ejection tray 104 upon rotation of the fourth to seventh conveyance rollers 115*d* to 115*g* and the lower ejection roller 122 in the directions indicated by arrows A10 to A14, respectively.

Figure 3:
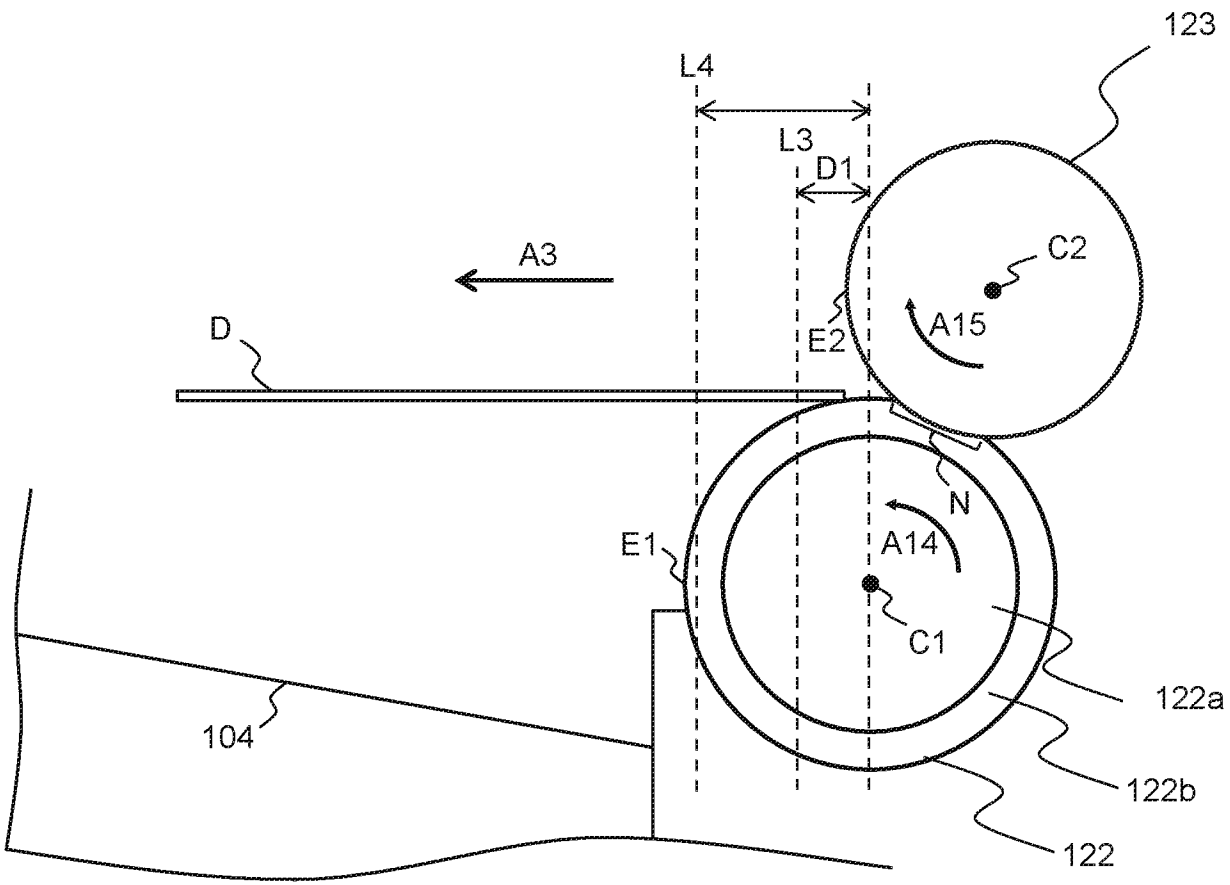
FIG. 3 is a schematic view for explaining the arrangement of an ejection roller pair.

FIG. 3 is a schematic view for explaining the arrangement of the ejection roller pair.

The lower ejection roller 122 is disposed under the upper ejection roller 123 to face the upper ejection roller 123, as illustrated in FIG. 3. The lower ejection roller 122 includes a shaft portion 122*a* made of, e.g., a resin material, and an outer circumferential portion 122*b* made of, e.g., a rubber material, and a nip N is formed between the lower ejection roller 122 and the upper ejection roller 123.

In the medium ejection direction A3, a center C1 of the lower ejection roller 122 is located downstream of a center C2 of the upper ejection roller 123. An end E1 of the lower ejection roller 122 on the downstream side in the medium ejection direction A3 is located on the downstream side, in the medium ejection direction A3, of an end E2 of the upper ejection roller 123 on the downstream side in the medium ejection direction A3. Since the end E1 of the lower ejection roller 122 is located downstream of the end E2 of the upper ejection roller 123, the medium is ejected slightly upwards. This restrains the leading edge of the medium from strongly colliding with the ejection tray 104 and the medium from being bent. However, the medium is still in contact with the outer circumferential portion 122*b* of the lower ejection roller 122 even after passage through the nip N, and therefore may be strongly pushed out to the downstream side in the medium ejection direction A3 by the lower ejection roller 122.

In the medium ejection direction A3, the downstream end E1 of the lower ejection roller 122 may be located at the same position as that of the downstream end E2 of the upper ejection roller 123, or upstream of the downstream end E2 of the upper ejection roller 123.

Figure 4:
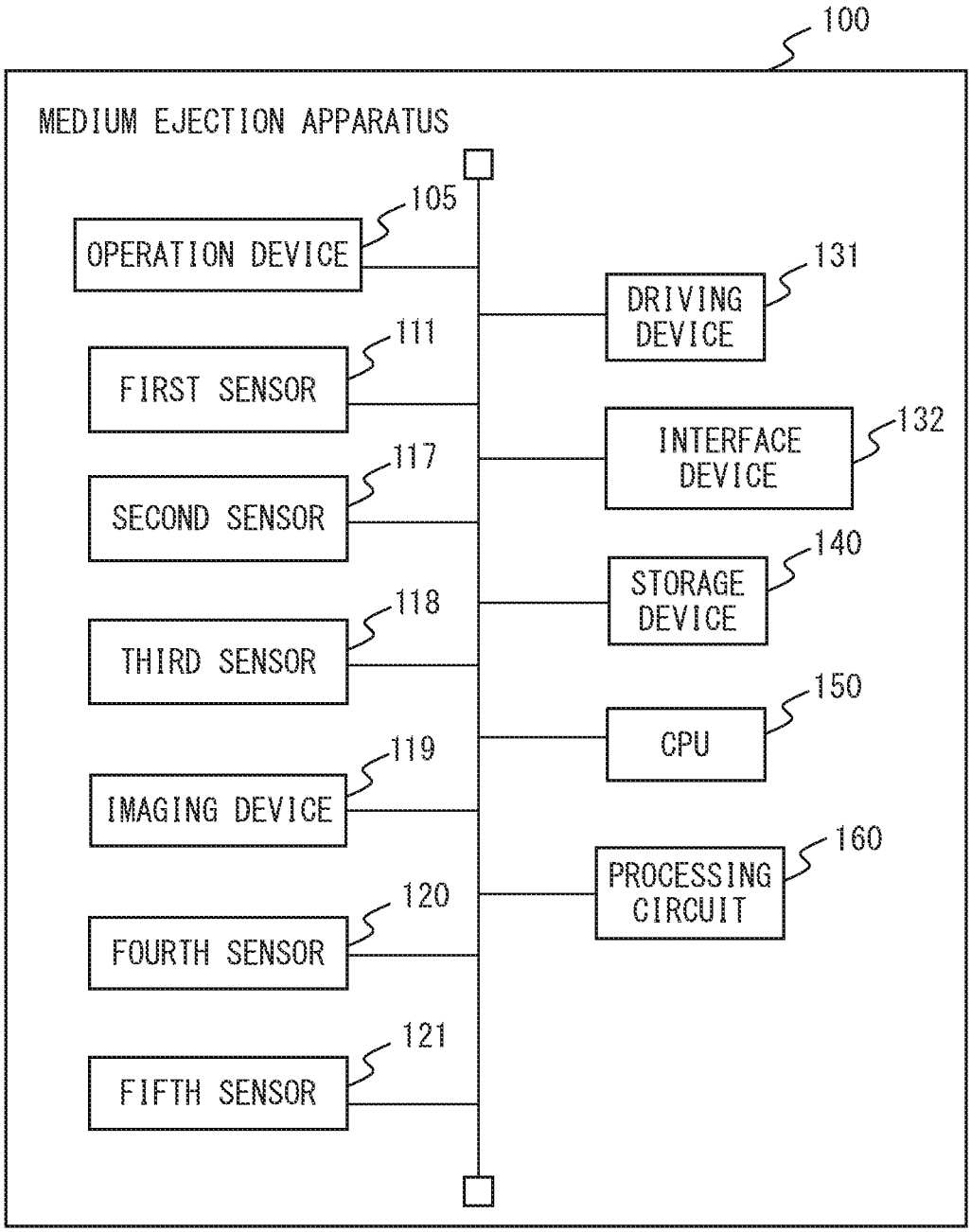
FIG. 4 is a block diagram illustrating the schematic configuration of the medium ejection apparatus 100.

FIG. 4 is a block diagram depicting schematic components of the medium ejection apparatus 100.

In addition to the above-described components, the medium ejection apparatus 100 further includes a driving device 131, an interface device 132, a storage device 140, a Central Processing Unit (CPU) 150, a processing circuit 160, etc.

The driving device 131 is an example of driving module, and includes one or a plurality of motors and rotates the pick roller 111, the feed roller 112, the break roller 114, the first to seventh conveyance rollers 115*a* to 115*g*, and the lower ejection roller 122 according to a control signal from the CPU 150 to convey a medium. For example, the driving device 131 includes first to fifth motors. The first motor rotates the pick roller 112, the second motor rotates the feed roller 113 and the brake roller 114, the third motor rotates the first conveyance roller 115*a*, and the fourth motor rotates the second to seventh conveyance rollers 115*b* to 115*g*. The fifth motor rotates the lower ejection roller 122. The upper ejection roller 123 performs driven rotation following rotation of the lower ejection roller 122. The upper ejection roller 123 may be provided to rotate by a driving force produced by the fifth motor or another motor. The lower ejection roller 122 is an example of at least one roller of the ejection roller pair, which is rotated by the driving device 131.

The interface device 131 has an interface circuit conforming to a serial bus such as Universal Serial Bus (USB). The interface device 131 transmits and receives various images and information through a communication connection with the information processing apparatus, not shown (for example, a personal computer, a portable information terminal, etc.). Instead of the interface device 131, a communication device that has an antenna for transmitting and receiving wireless signals and a wireless communication interface circuit for transmitting and receiving signals via a wireless communication channel according to a predetermined communication protocol may be used. The predetermined communication protocol may be, for example, a wireless local area network (LAN).

The storage device 140 includes: a memory device, such as a random access memory (RAM) and a read only memory (ROM); a fixed disk device, such as a hard disk; or a portable storage device, such as a flexible disk and an optical disk. The storage device 140 stores a computer program, a database, a table, etc., that are used for various processing of the medium ejection apparatus 100. The computer program may be installed on the storage device 140 from a computer-readable, non-transitory medium such as a compact disk read only memory (CD-ROM), a digital versatile disk read only memory (DVD-ROM), etc., by using a well-known setup program, etc.

The CPU 150 operates according to a program stored in advance in the storage device 140. Note that a digital signal processor (DSP), a large scale integration (LSI), etc., may be used instead of the first CPU 150. Alternatively, an Application Specific Integrated Circuit (ASIC), a field-programming gate array (FPGA) etc., may be used instead of the first CPU 150.

The first CPU 150 is connected to the operation device 105, the display device 106, the first sensor 111, the second sensor 117, the third sensor 118, the imaging device 119, the fourth sensor 120, the fifth sensor 121, the interface device 131, the storage device 140, the processing circuit 160, etc., and controls these components. The CPU 150 not only performs driving control of the driving device 131 in accordance with a detection signal from each sensor, but also performs, e.g., medium reading control of the imaging device 119 to acquire an input image.

The processing circuit 160 performs predetermined image processing on the input image acquired from the imaging device 119. The processing circuit 160 stores the processed input image in the storage device 140. Note that a LSI, a DSP, an ASIC, a FPGA, etc., may be used as the processing circuit 160.

Figure 5:
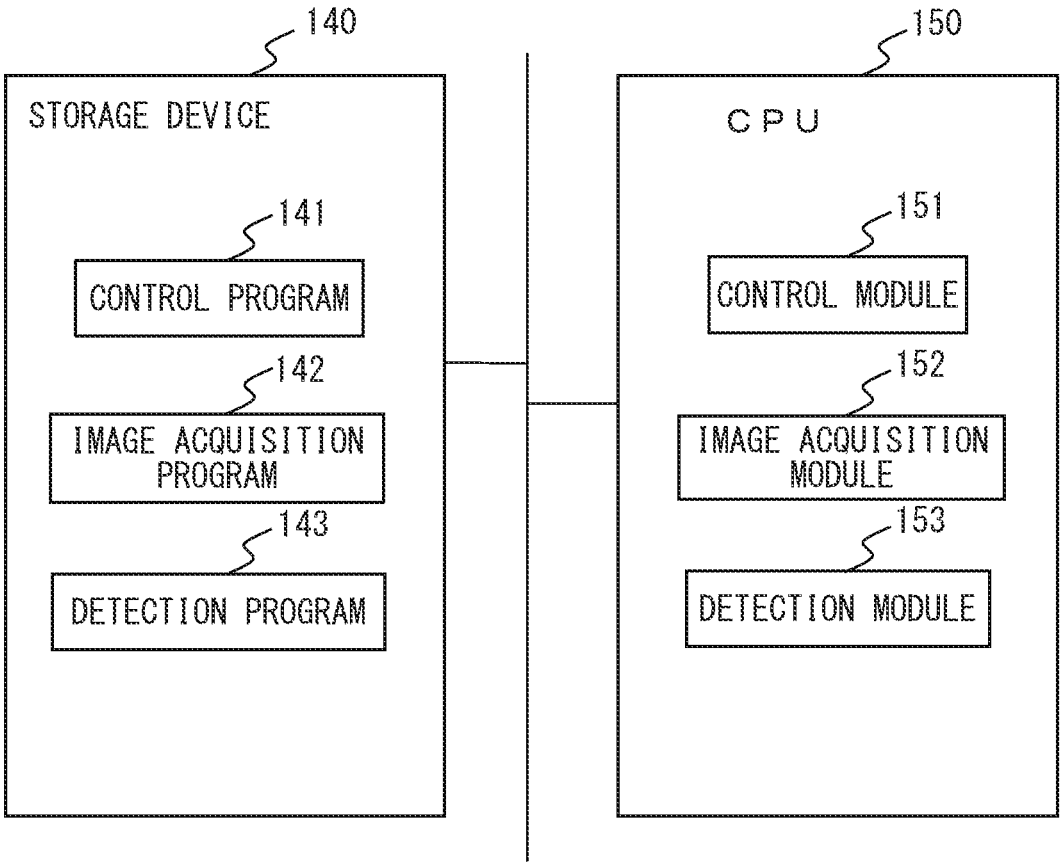
FIG. 5 is a diagram illustrating the schematic configuration of a storage device 140 and a CPU 150.

FIG. 5 is a view depicting the schematic components of the storage device 140 and the CPU 150 of the medium ejection apparatus 100.

The storage device 140 stores each program such as a control program 141, an image acquisition program 142, and a detection program 143, as illustrated in FIG. 5. Each of these programs serves as a functional module implemented as software running on a processor. The CPU 150 functions as a control module 151, an image acquisition module 152, and a detection module 153 by reading each program stored in the storage device 140 and operating in accordance with each read program.

Figure 6:
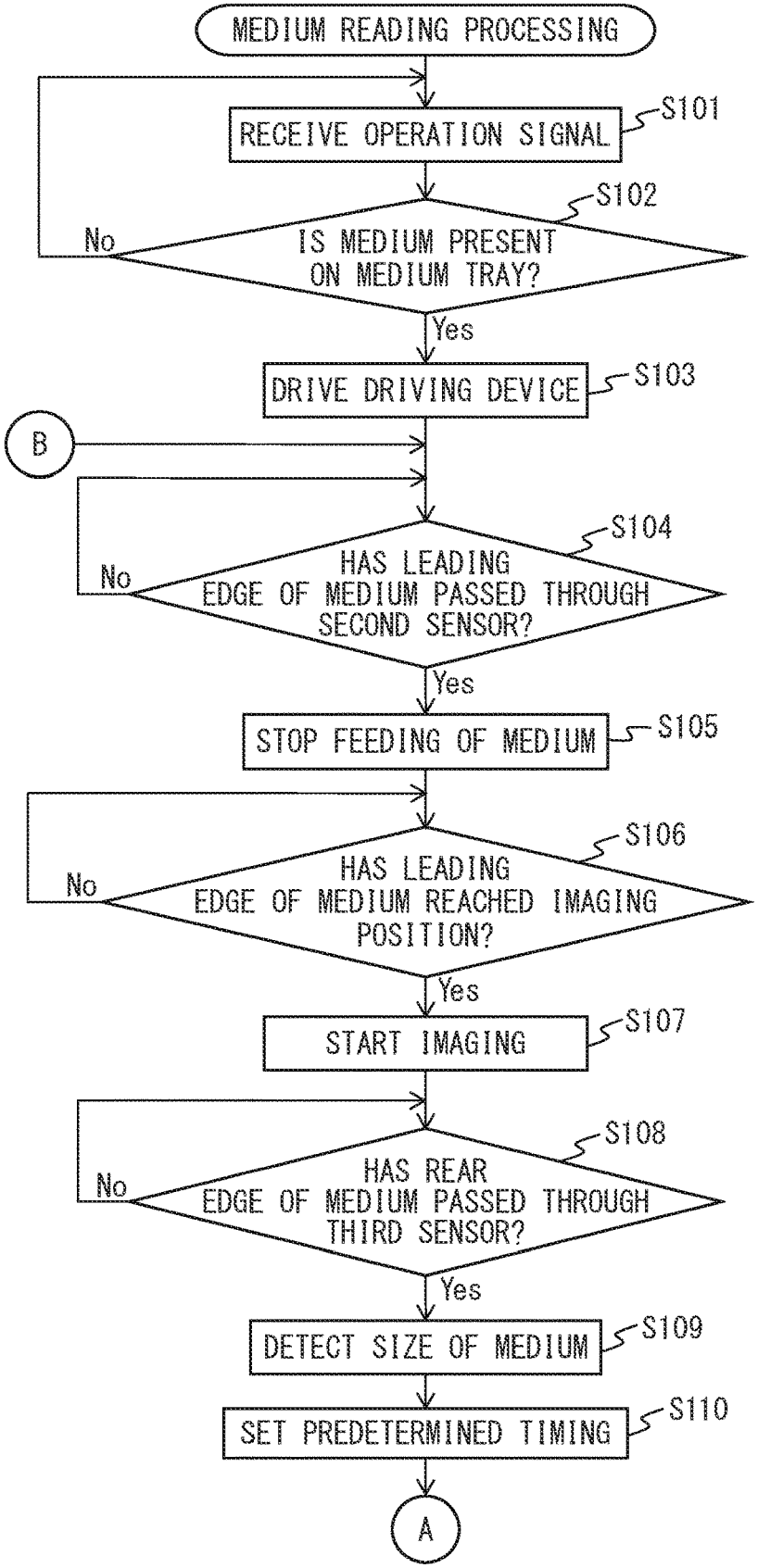
FIG. 6 is a flowchart illustrating an exemplary operation of medium reading processing.
Figure 7:
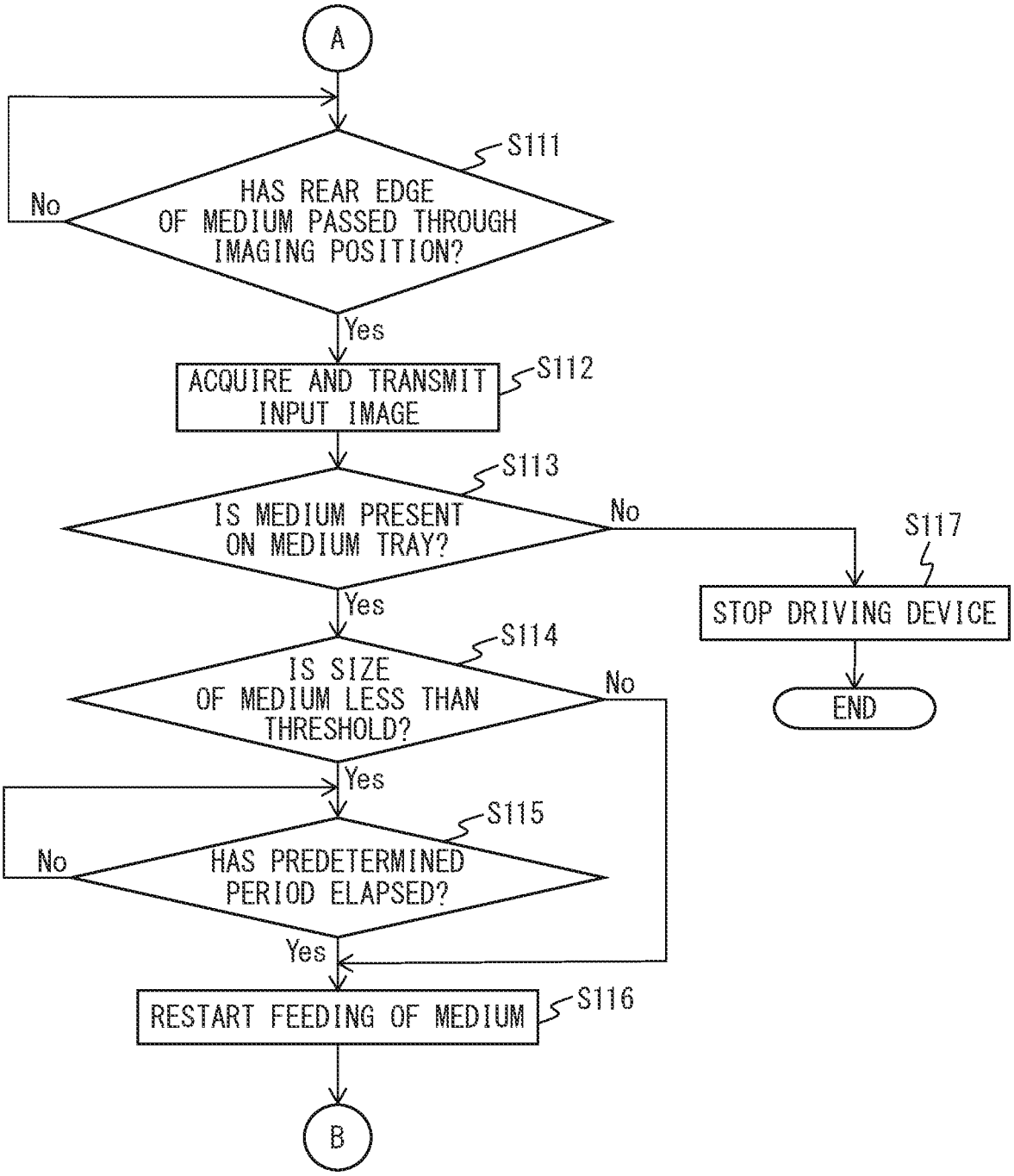
FIG. 7 is a flowchart illustrating another exemplary operation of the medium reading processing.

FIG. 6 and FIG. 7 are flowcharts depicting an example of the operation of the medium reading processing of the medium ejection apparatus 100.

The following will describe an example of the operation of the medium reading processing of the medium ejection apparatus 100 with reference to the flowcharts depicted in FIG. 6 and FIG. 7. Note that the operation flow as will be described below is performed primarily by the CPU 150 jointly with each component of the medium ejection apparatus 100 according to programs prestored in the storage device 140.

First, the control module 151 stands by to receive an operation signal for issuing a medium reading instruction from the operation device 105, in response to the medium reading instruction input using the operation device 105 by a user (step S101).

The control module 151 then acquires a first detection signal from the first sensor 111, and determines whether a medium has been mounted on the medium tray 103, based on the acquired first detection signal (step S102). When no medium has been mounted on the medium tray 103, the control module 151 returns the process to step S101, in which it stands by to receive a new operation signal from the operation device 105.

When a medium has been mounted on the medium tray 103, the control module 151 drives the driving device 131 (step S103). The control module 151 rotates the pick roller 112, the feed roller 113, the brake roller 114, the first to seventh conveyance rollers 115*a* to 115*g*, and the lower ejection roller 122, and feeds and conveys the medium mounted on the medium tray 103. In this case, the control module 151 sets the rotation speed of the lower ejection roller 122 to a first speed. The first speed is a rotation speed to move the medium at the speed at which the medium moves by the feed roller 113 and the first to seventh conveyance rollers 115*a* to 115*g*.

The control module 151 stands by until the leading edge of the medium passes through the position of the second sensor 117 (step S104). The control module 151 determines whether the leading edge of the medium has passed through the position of the second sensor 117, based on a second detection signal received from the second sensor 117. The control module 151 periodically receives a second detection signal from the second sensor 117, and determines that the leading edge of the medium has passed through the position of the second sensor 117, when the value of the second detection signal has changed from a value indicating that a medium is absent to a value indicating that a medium is present.

When the leading edge of the medium passes through the position of the second sensor 117, the control module 151 stops rotating the pick roller 112, the feed roller 113, and the brake roller 114 to, in turn, stop feeding the medium (step S105). The medium fed by the feed roller 113 and the brake roller 114 is subsequently conveyed by the first to seventh conveyance rollers 115*a* to 115*g* and the lower ejection roller 122, and no subsequent medium is fed.

The image acquisition module 152 stands by until the leading edge of the medium reaches each of the imaging positions L1 and L2 of the imaging device 119 (step S106). The image acquisition module 152 determines whether the leading edge of the medium has reached each of the imaging positions L1 and L2 of the imaging device 119, in accordance with whether a predetermined time has elapsed from the start of feeding the medium. The image acquisition module 152 may determine whether the leading edge of the medium has reached each of the imaging positions L1 and L2 of the imaging device 119, based on a third detection signal received from the third sensor 118. The image acquisition module 152 periodically receives a third detection signal from the third sensor 118, and determines that the leading edge of the medium has passed through the position of the third sensor 118, when the value of the third detection signal has changed from a value indicating that a medium is absent to a value indicating that a medium is present. The image acquisition module 152 regards the leading edge of the medium as having reached each of the imaging positions L1 and L2 of the imaging device 119, when the leading edge of the medium has passed through the position of the third sensor 118 or when a predetermined time has elapsed after passage of the leading edge of the medium through the position of the third sensor 118.

When the leading edge of the medium reaches each of the imaging positions L1 and L2 of the imaging device 119, the image acquisition module 152 starts to capture an image of the conveyed medium by the imaging device 119 (step S107). When the leading edge of the medium reaches the imaging position L1, the image acquisition module 152 causes the first imaging device 119*a* to start to capture an image of the medium. When the leading edge of the medium reaches the imaging position L2, the image acquisition module 152 causes the second imaging device 119*b* to start to capture an image of the medium.

The detection module 153 stands by until the rear edge of the medium passes through the position of the third sensor 118 (step S108). The control module 151 determines whether the rear edge of the medium has passed through the position of the third sensor 118, based on a third detection signal received from the third sensor 118. The control module 151 periodically receives a third detection signal from the third sensor 118, and determines that the rear edge of the medium has passed through the position of the third sensor 118, when the value of the third detection signal has changed from a value indicating that a medium is present to a value indicating that a medium is absent.

When the rear edge of the medium passes through the position of the third sensor 118, the detection module 153 detects the size of the medium (step S109). The detection module 153 detects the size of the medium, based on, e.g., the third detection signal received from the third sensor 118. The detection module 153 detects the size of the medium in the medium conveyance direction A2 by multiplying, by the conveyance speed of the medium, the time since the leading edge of the medium passes through the position of the third sensor 118 until the rear edge of the medium passes through the position of the third sensor 118. The detection module 153 may detect the size of the medium, based on an input image generated by the imaging device 119. In this case, the detection module 153 detects a medium from the input image, using a known image processing technique, and specifies the size of the detected medium.

The control module 151 sets a predetermined timing to increase the rotation speed of the lower ejection roller 122 (step S110). As will be described later, the control module 151 reduces the rotation speed of the lower ejection roller 122 to a second speed lower (slower) than the first speed (deceleration), from a second predetermined timing earlier than the predetermined timing. After that, the control module 151 increases the rotation speed of the lower ejection roller 122 from the second speed to the first speed again (reacceleration), from the predetermined timing. The second predetermined timing is set in advance to a timing before the rear edge of the medium passes through the nip position of the ejection roller pair.

The predetermined timing is set to a timing after the rear edge of the medium passes through the nip position of the ejection roller pair. When the size of the medium is equal to or larger than a threshold, the control module 151 sets the predetermined timing to a first timing, and when the size of the medium is less than the threshold, the control module 151 sets the predetermined timing to a second timing later than the first timing. The threshold is set to a medium size (e.g., A5 size) which allows the leading edge of the medium to come into contact with the mount surface of the ejection tray 104 when the rear edge of the medium passes through the nip position of the ejection roller pair. The first timing is set to the timing at which the rear edge of the medium reaches a position L3 more to the downstream side by a first distance D1 than the center C1 of the lower ejection roller 122 in the medium ejection direction A3 (see FIG. 3). The second timing is set to the timing at which the rear edge of the medium reaches a position L4 more to the downstream side by a second distance D2 than the center C1 of the lower ejection roller 122 in the medium ejection direction A3.

The first distance D1 is set to, e.g., 4 mm, and the second distance D2 is set to, e.g., 10 mm, which is longer than the first distance D1. In this manner, the control module 151 sets the predetermined timing when the size of the medium is less than a threshold to a timing later than the predetermined timing when the size of the medium is equal to or larger than the threshold.

When the size of the medium in the medium conveyance direction A2 is equal to or larger than a threshold, the control module 151 may set the predetermined timing to the first timing, and when the size of the medium in the medium conveyance direction A2 is less than the threshold, the control module 151 may set the predetermined timing to the second timing. In this case, the threshold is set to, e.g., 126 mm. The control module 151 may even classify the predetermined timing into three or more multiple stages, so that the smaller the size of the medium, the later the predetermined timing. In this manner, the control module 151 changes the predetermined timing in accordance with the size of the medium.

The image acquisition module 152 stands by until the rear edge of the medium passes through each of the imaging positions L1 and L2 of the imaging device 119 (step S111). The image acquisition module 152 determines whether the rear edge of the medium has passed through each of the imaging positions L1 and L2 of the imaging device 119, in accordance with whether a predetermined time has elapsed after passage of the rear edge of the medium through the position of the third sensor 118. The image acquisition module 152 may determine whether the rear edge of the medium has passed through each of the imaging positions L1 and L2 of the imaging device 119, based on a fourth detection signal received from the fourth sensor 120. The image acquisition module 152 periodically receives a fourth detection signal from the fourth sensor 120, and determines that the rear edge of the medium has passed through the position of the fourth sensor 120, when the value of the fourth detection signal has changed from a value indicating that a medium is present to a value indicating that a medium is absent. The image acquisition module 152 regards the medium as having passed through each of the imaging positions L1 and L2 of the imaging device 119, when the rear edge of the medium has passed through the position of the fourth sensor 120.

When the rear edge of the medium passes through each of the imaging positions L1 and L2 of the imaging device 119, the image acquisition module 152 acquires an input image from the imaging device 119 and transmits the acquired input image to an information processing apparatus (not illustrated) via the interface device 132 (step S112). When the rear edge of the medium passes through the imaging position L1, the image acquisition module 152 acquires an input image from the first imaging device 119*a*, and when the rear edge of the medium passes through the imaging position L2, the image acquisition module 152 acquires an input image from the second imaging device 119*b*.

The control module 151 determines whether a medium remains on the medium tray 103, based on the first detection signal received from the first sensor 111 (step S113).

When a medium remains on the medium tray 103, the control module 151 determines whether the size of the medium detected by the detection module 153 is less than the threshold (step S114).

When the size of the medium is less than the threshold, the control module 151 stands by until a predetermined period elapses (step S115). With this operation, the subsequent medium stands by on the upstream side of the feed roller 113 and the brake roller 114 without being fed by the feed roller 113 and the brake roller 114. When the size of the medium is equal to or larger than the threshold, the control module 151 advances the process to step S116 without standing by.

The control module 151 drives the driving device 131 to rotate the pick roller 112, the feed roller 113, and the brake roller 114 to restart feed of the medium (step S116). The control module 151 returns the process to step S104, in which it repeats the processes in steps S104 to S116. In this manner, the control module 151 stops feeding of the subsequent medium for a predetermined period when the size of the medium is less than the threshold.

As described above, the timing to reaccelerate the lower ejection roller 122 when the size of the medium is less than the threshold is set later than that to reaccelerate the lower ejection roller 122 when the size of the medium is equal to or larger than the threshold. For this reason, the leading edge of a medium to be conveyed next may approach too much the rear edge of a medium having a size less than the threshold. The control module 151 can prevent the leading edge of a medium to be conveyed next from approaching too much the rear edge of a medium having a size less than the threshold, by stopping feed of the subsequent medium for a predetermined period, when the size of the medium is less than the threshold. The predetermined period is preferably set to a time which allows the rear edge of a medium having a size less than the threshold to be later than the rear edge of a medium having a size equal to or larger than the threshold. Hence, the control module 151 can ensure a distance between media, when the size of the medium is less than the threshold, equal to that between media when the size of the medium is equal to or larger than the threshold.

The timing to start feed of the subsequent medium is not limited to a timing after the rear edge of the medium being conveyed passes through each of the imaging positions L1 and L2 of the imaging device 119. The control module 151 may start feed of the subsequent medium, in the range in which the subsequent medium does not overtake the medium being conveyed, even when the medium being conveyed is decelerated. Even in this case, when the size of the medium is less than the threshold, the control module 151 stops feeding of the subsequent medium for a predetermined period to ensure a distance between media equal to that between media when the size of the medium is equal to or larger than the threshold.

In step S113, when no medium remains on the medium tray 103, the control module 151 stops the driving device 131 to stop rotation of each roller (step S117), and a series of steps ends.

Figure 8:
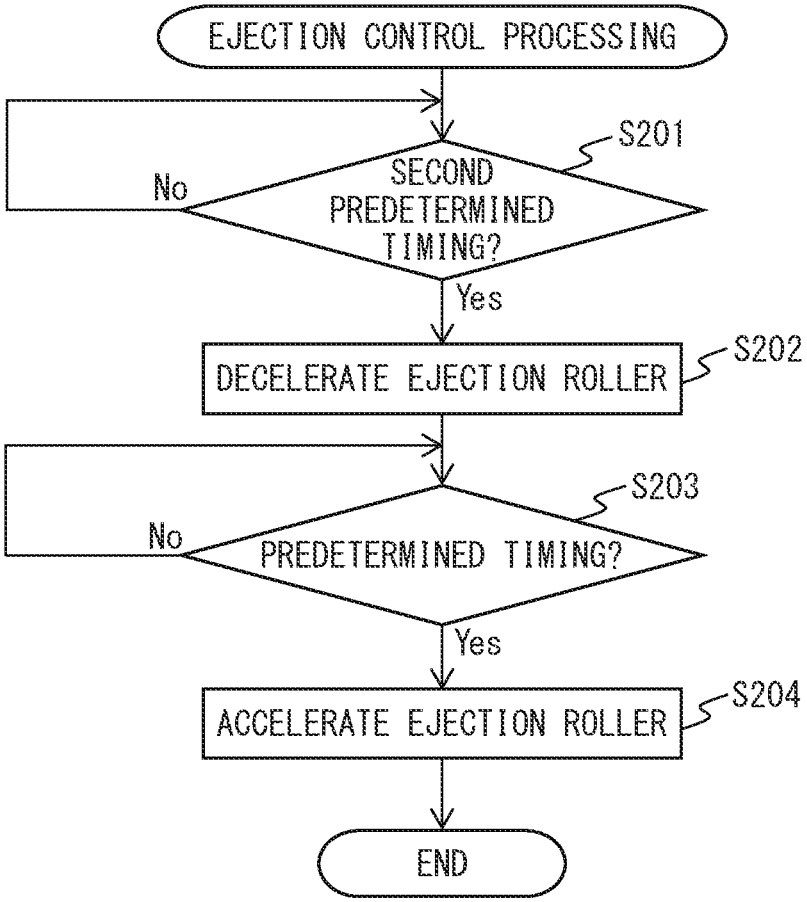
FIG. 8 is a flowchart illustrating an exemplary operation of ejection control processing.

FIG. 8 is a flowchart illustrating an exemplary operation of ejection control processing.

An exemplary operation of ejection control processing by the medium ejection apparatus 100 will be described below with reference to the flowchart illustrated in FIG. 8. The following operation sequence is executed mainly by the CPU 150 in cooperation with the elements of the medium ejection apparatus 100, based on the programs stored in the storage device 140 in advance. The ejection control processing is performed every time one medium is conveyed.

First, the control module 151 stands by until the current time instant reaches a second predetermined timing (step S201). The second predetermined timing is set in advance to the timing at which the rear edge of the medium reaches a predetermined position between the lower ejection roller 122 and the seventh conveyance roller 115*g* placed closest to the lower ejection roller 122 among the first to seventh conveyance rollers 115*a* to 115*g*.

The control module 151 determines whether the current time instant has reached the second predetermined timing, based on, e.g., a fourth detection signal received from the fourth sensor 120. The control module 151 periodically receives a fourth detection signal from the fourth sensor 120, and determines that the rear edge of the medium has passed through the position of the fourth sensor 120, when the value of the fourth detection signal has changed from a value indicating that a medium is present to a value indicating that a medium is absent. The control module 151 determines that the current time instant has reached the second predetermined timing, when a time set in advance as the time since the rear edge of the medium passes through the position of the fourth sensor 120 until the rear edge of the medium reaches the predetermined position between the seventh conveyance roller 115*g* and the lower ejection roller 122 has elapsed. The control module 151 may determine whether the current time instant has reached the second predetermined timing, based on a detection signal received from another sensor.

When the current time instant reaches the second predetermined timing, the control module 151 controls the driving device 131 to decelerate the lower ejection roller 122 by reducing the rotation speed of the lower ejection roller 122 from the first speed to the second speed (step S202). In this manner, the control module 151 controls the driving device 131 to reduce the rotation speed of the lower ejection roller 122 to be lower than the previous rotation speed, from the second predetermined timing.

The control module 151 stands by until the current time instant reaches a predetermined timing (step S203). The predetermined timing is set to the timing at which the rear edge of the medium reaches each position according to the size of the medium, on the downstream side of the nip position of the ejection roller pair, in step S110 of FIG. 6.

The control module 151 determines whether the current time instant has reached the predetermined timing, based on, e.g., a fifth detection signal received from the fifth sensor 121. The control module 151 periodically receives a fifth detection signal from the fifth sensor 121, and determines that the rear edge of the medium has passed through the position of the fifth sensor 121, when the value of the fifth detection signal has changed from a value indicating that a medium is present to a value indicating that a medium is absent. The control module 151 determines that the current time instant has reached the predetermined timing, when a time set in advance as the time since the rear edge of the medium passes through the position of the fifth sensor 121 until the rear edge of the medium reaches each position according to the size of the medium, on the downstream side of the nip position of the ejection roller pair, has elapsed. The control module 151 may determine whether the current time instant has reached the predetermined timing, based on a detection signal received from another sensor.

When the current time instant reaches the predetermined timing, the control module 151 controls the driving device 131 to accelerate the lower ejection roller 122 by raising the rotation speed of the lower ejection roller 122 from the second speed to the first speed (step S204), and a series of steps ends. In this manner, the control module 151 controls the driving device 131 to increase the rotation speed of the lower ejection roller 122 to be higher than the previous rotation speed, from the predetermined timing.

Figure 9A:
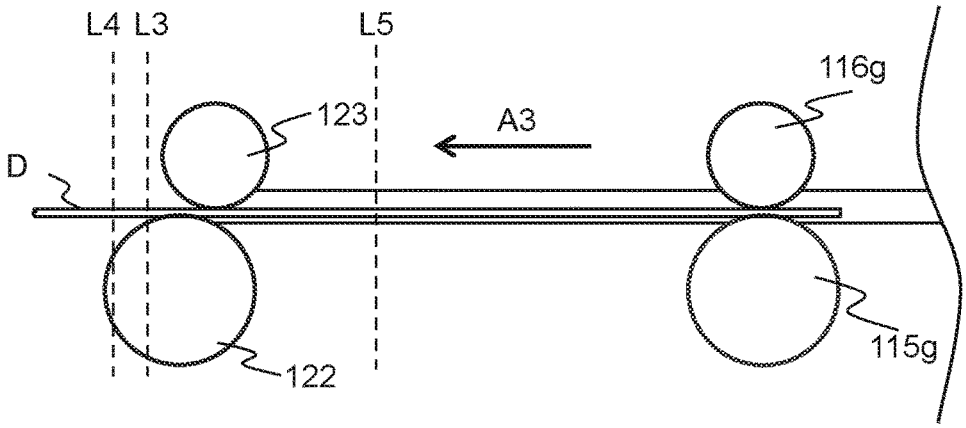
FIG. 9A is a schematic view for explaining each timing.
Figure 9B:
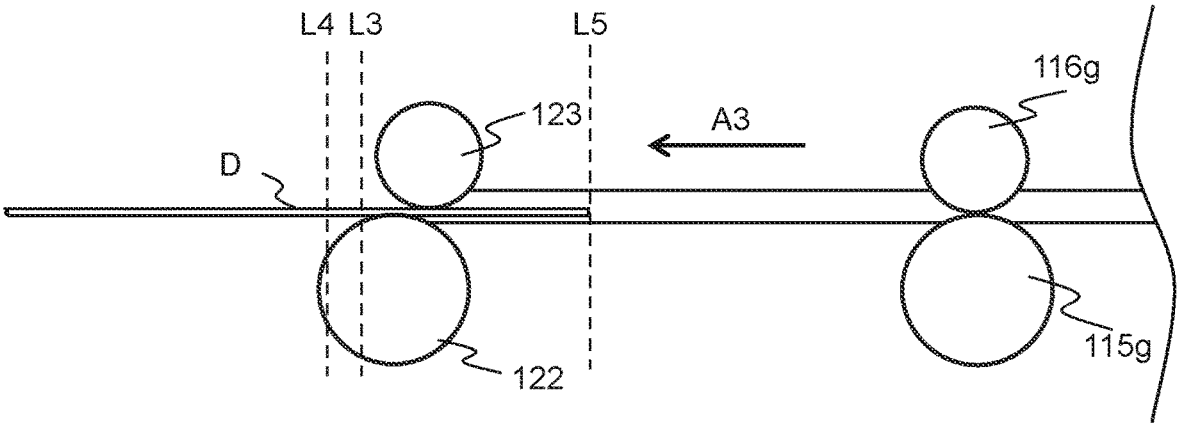
FIG. 9B is a schematic view for explaining each timing.
Figure 10A:
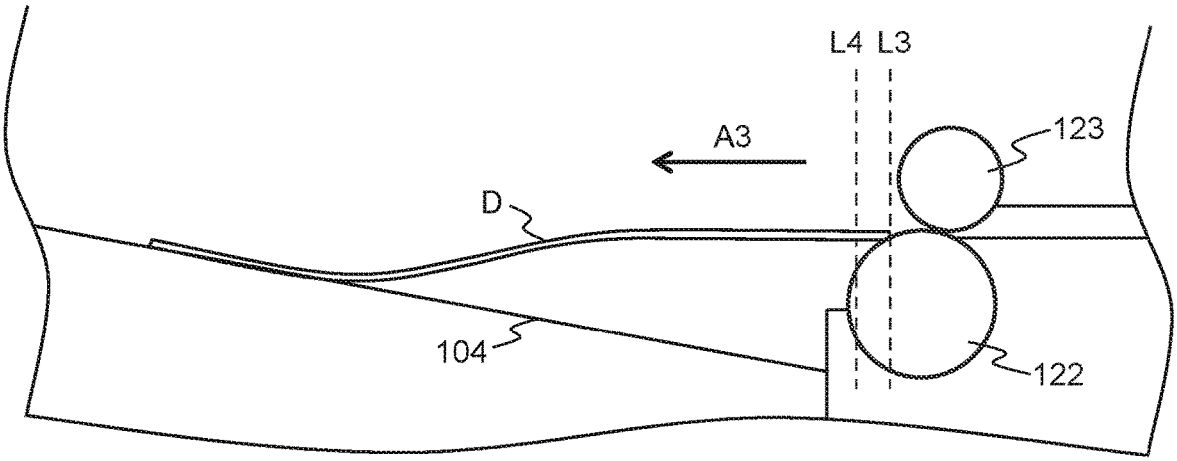
FIG. 10A is a schematic view for explaining each timing.
Figure 10B:
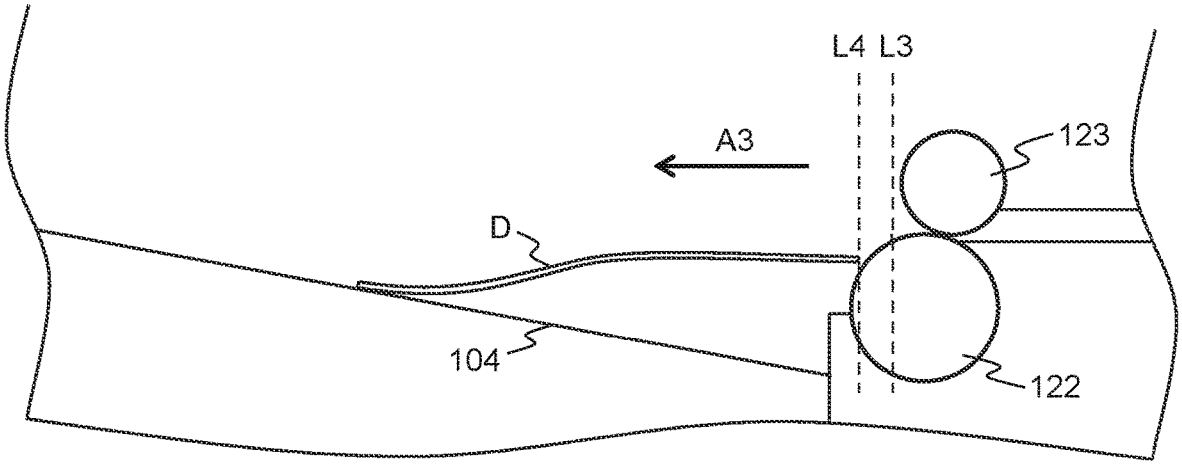
FIG. 10B is a schematic view for explaining each timing.

FIGS. 9A, 9B, 10A, and 10B are schematic views for explaining each timing in the ejection control processing. FIG. 9A illustrates a state before the second predetermined timing, FIG. 9B illustrates a state at the second predetermined timing, FIG. 10A illustrates a state at the predetermined timing when the size of the medium is equal to or larger than the threshold, and FIG. 10B illustrates a state at the predetermined timing when the size of the medium is less than the threshold.

In the examples illustrated in FIGS. 9A and 9B, the second predetermined timing is set to the timing at which the rear edge of the medium reaches a predetermined position L5 between the seventh conveyance roller 115*g* and the lower ejection roller 122. The predetermined timing when the size of the medium is equal to or larger than the threshold is set to the timing at which the rear edge of the medium reaches the position L3 located downstream of the nip position of the ejection roller pair. The predetermined timing when the size of the medium is less than the threshold is set to the timing at which the rear edge of the medium reaches the position L4 more to the downstream side than the position L3.

As illustrated in FIG. 9A, in the state before the second predetermined timing, the rotation speed of the lower ejection roller 122 is set to the first speed, and a medium D is ejected by the lower ejection roller 122 at a speed equal to that of conveyance by the first to seventh conveyance rollers 115*a* to 115*g*. Since the medium D is conveyed (ejected) by the first to seventh conveyance rollers 115*a* to 115*g* and the lower ejection roller 122 at the same speed, the medium D does not warp between the first to seventh conveyance rollers 115*a* to 115*g* and the lower ejection roller 122.

As illustrated in FIG. 9B, in the state at the second predetermined timing, the rotation speed of the lower ejection roller 122 is set to the second speed, and the lower ejection roller 122 is decelerated. With this operation, the ejected medium D is restrained from being strongly pushed out by the lower ejection roller 122, and the rear edge of the medium D ejected onto the ejection tray 104 is restrained from being spaced apart from the downstream end of the ejection tray 104 in the medium ejection direction A3. Therefore, the second predetermined timing is preferably set to a timing which allows sufficient deceleration of the medium D before the rear edge of the medium D passes through the nip position of the ejection roller pair.

The second predetermined timing is set to a timing after the rear edge of the medium D passes through the seventh conveyance roller 115*g* placed closest to the lower ejection roller 122 among the first to seventh conveyance rollers 115*a* to 115*g*. At the second timing, since the medium D is not conveyed by the first to seventh conveyance rollers 115*a* to 115*g*, the medium D does not warp between the first to seventh conveyance rollers 115*a* to 115*g* and the lower ejection roller 122 even upon deceleration of the lower ejection roller 122.

As illustrated in FIG. 10A, when the size of the medium D is equal to or larger than the threshold, as the rear edge of the medium D reaches the position L3, the rotation speed of the lower ejection roller 122 is reset (returned) to the first speed, and the lower ejection roller 122 is reaccelerated. In this case, the rear edge of the medium D is still in contact with the lower ejection roller 122, and the medium D is strongly pushed out by the force of reacceleration of the lower ejection roller 122. However, since the leading edge of the medium D has already reached the ejection tray 104, the medium D is not pushed out too much by the friction between the medium D and the ejection tray 104. Therefore, the medium D is ejected onto the ejection tray 104 so that the rear edge of the medium D is located at the downstream end of the ejection tray 104.

If the size of the medium D is less than the threshold, when the lower ejection roller 122 is reaccelerated as the rear edge of the medium D reaches the position L3, the leading edge of the medium D has not yet reached the ejection tray 104 at this time. Therefore, the medium D pushed out by the lower ejection roller 122 is thrown into the air and ejected onto the ejection tray 104 so that the rear edge of the medium D is spaced apart from the downstream end of the ejection tray 104.

As illustrated in FIG. 10B, when the size of the medium D is less than the threshold, as the rear edge of the medium D reaches the position L4, the rotation speed of the lower ejection roller 122 is reset (returned) to the first speed, and the lower ejection roller 122 is reaccelerated. In this case, the rear edge of the medium D is spaced apart from the lower ejection roller 122. Even if the rear edge of the medium D is in contact with the lower ejection roller 122, it is in contact with the vicinity of the downstream end of the lower ejection roller 122. This means that a large force applied by the lower ejection roller 122 acts on the medium D downwards, but less force acts on the medium D to the downstream side in the medium ejection direction A3. The medium D is not strongly pushed out by the lower ejection roller 122. The leading edge of the medium D has already reached the ejection tray 104, and the medium D is not pushed out too much by the friction between the medium D and the ejection tray 104. Therefore, a medium D having a size less than the threshold is also ejected onto the ejection tray 104 so that the rear edge of the medium D is located at the downstream end of the ejection tray 104.

In this manner, the medium ejection apparatus 100 can eject both a medium having a size equal to or larger than the threshold, and a medium having a size less than the threshold onto the ejection tray 104 so that the rear edges of the media are located at the downstream end of the ejection tray 104. With this operation, a user can easily jog the ejected media, and the medium ejection apparatus 100 can improve the convenience of the user.

Upon resetting of the lower ejection roller 122 to the first speed, the subsequent medium is conveyed (ejected) by the first to seventh conveyance rollers 115*a* to 115*g* and the lower ejection roller 122 at the same speed until the second timing is reached. Therefore, the subsequent medium does not warp between the first to seventh conveyance rollers 115*a* to 115*g* and the lower ejection roller 122.

The control module 151 may omit the processes in steps S201 and S202 of FIG. 8 and may not decelerate the lower ejection roller 122 immediately before medium ejection. Even in this case, the control module 151 can align the ejection positions of media having different sizes by changing the timing to increase the rotation speed of the lower ejection roller 122, in accordance with the size of the medium by the processes in steps S203 and S204.

As described in detail above, the medium ejection apparatus 100 aligns the ejection positions of media, regardless of the size of the medium, by changing the timing to increase the rotation speed of the lower ejection roller 122, in accordance with the size of the medium. With this operation, even when media having different sizes are conveyed, the medium ejection apparatus 100 can eject the media to more suitably align the positions of the media ejected onto the ejection tray 104.

In discharging a small medium, the medium ejection apparatus 100 prolongs the deceleration period of the lower ejection roller 122 to prevent the small medium from being strongly pushed out and mounted at a downstream position on the ejection tray 104. Hence, the medium ejection apparatus 100 can prevent the leading edge of a medium ejected later from entering a position under the rear edge of the small medium ejected last time and causing an interchange of the media. In discharging a large medium, the medium ejection apparatus 100 does not increase the deceleration period of the lower ejection roller 122, and can therefore align the positions of the rear edges of ejected media without degrading the conveyance performance of the large medium.

The medium ejection apparatus 100 changes the timing to increase the rotation speed of the lower ejection roller 122, under the control of software. Accordingly, in a sold medium ejection apparatus, the ejection positions of media can be aligned simply by changing the software, without changing the hardware.

Figure 11:
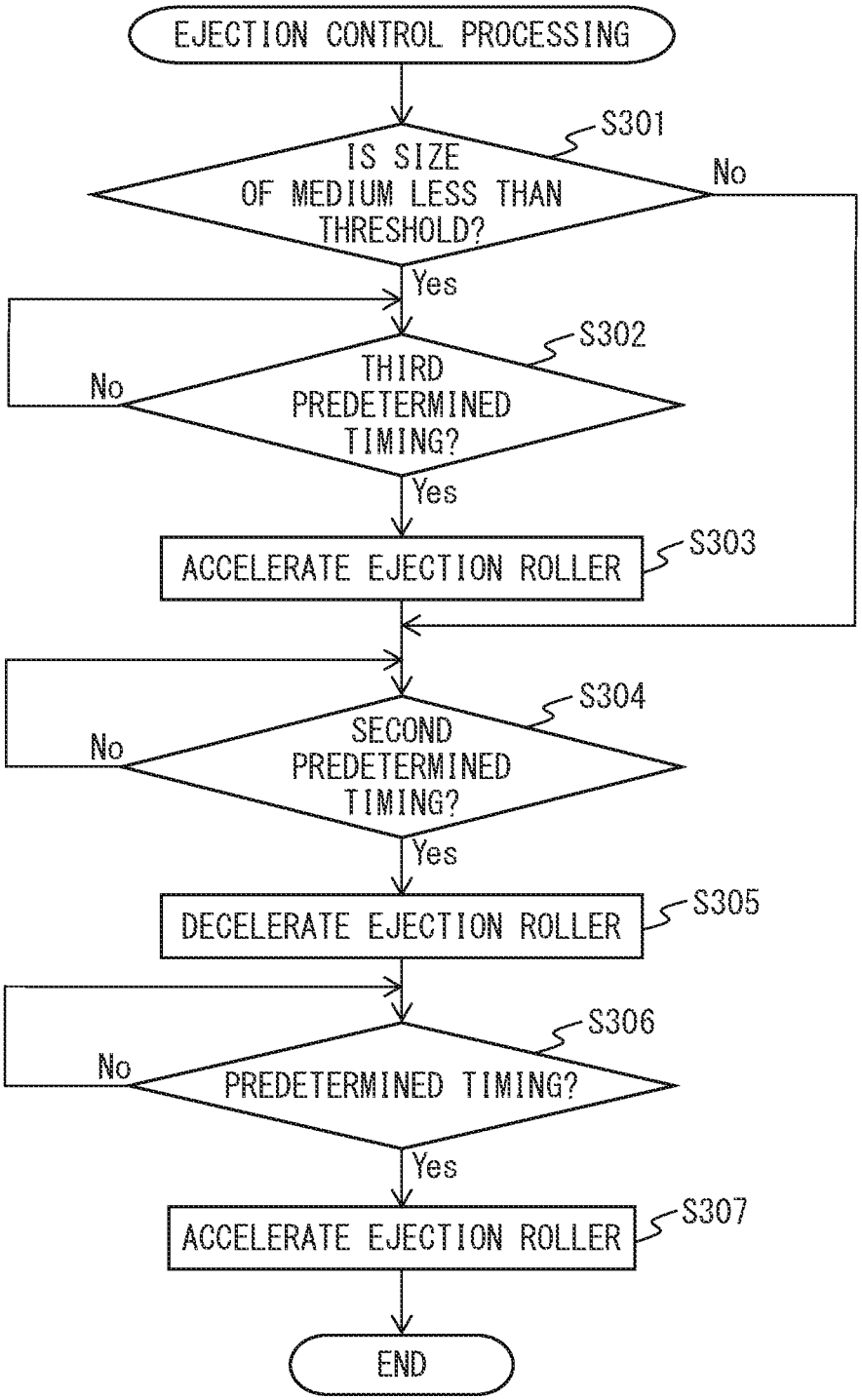
FIG. 11 is a flowchart illustrating an exemplary operation of another ejection control processing.

FIG. 11 is a flowchart illustrating an exemplary operation of ejection control processing according to another embodiment.

The flowchart illustrated in FIG. 11 is executed in place of the flowchart illustrated in FIG. 8. Since the processes in steps S304 to S307 of the flowchart illustrated in FIG. 11 are the same as those in steps S201 to S204 of the flowchart illustrated in FIG. 8, a detailed description thereof will not be given, and only the processes in steps S301 to S303 will be described below. When the ejection control processing illustrated in FIG. 11 is performed, the processes in steps S114 and S115 of the flowchart illustrated in FIG. 7 may be omitted.

First, the control module 151 determines whether the size of the medium detected by the detection module 153 is less than the threshold (step S301). When the size of the medium is equal to or larger than the threshold, the control module 151 advances the process to step S304 without any particular processing.

When the size of the medium is less than the threshold, the control module 151 stands by until the current time instant reaches a third predetermined timing (step S302). The third predetermined timing is set in advance to a timing earlier than the second predetermined timing and after the rear edge of the medium passes through the seventh conveyance roller 115*g* placed closest to the ejection roller pair among the first to seventh conveyance rollers 115*a* to 115*g*. The control module 151 determines whether the current time instant has reached the third predetermined timing, as in the case where it determines whether the current time instant has reached the second predetermined timing.

When the current time instant reaches the third predetermined timing, the control module 151 controls the driving device 131 to accelerate the lower ejection roller 122 by raising the rotation speed of the lower ejection roller 122 from the first speed to a third speed (step S303). The third speed is higher (faster) than the first speed.

In this case, in step S305, when the current time instant reaches the second predetermined timing, the control module 151 controls the driving device 131 to decelerate the lower ejection roller 122 by reducing the rotation speed of the lower ejection roller 122 from the third speed to the second speed. In this manner, the control module 151 controls the driving device 131 to increase the rotation speed of the lower ejection roller 122 to be higher than the previous rotation speed, until the second predetermined timing comes after the rear edge of the medium passes through the seventh conveyance roller 115*g*.

Figure 12:
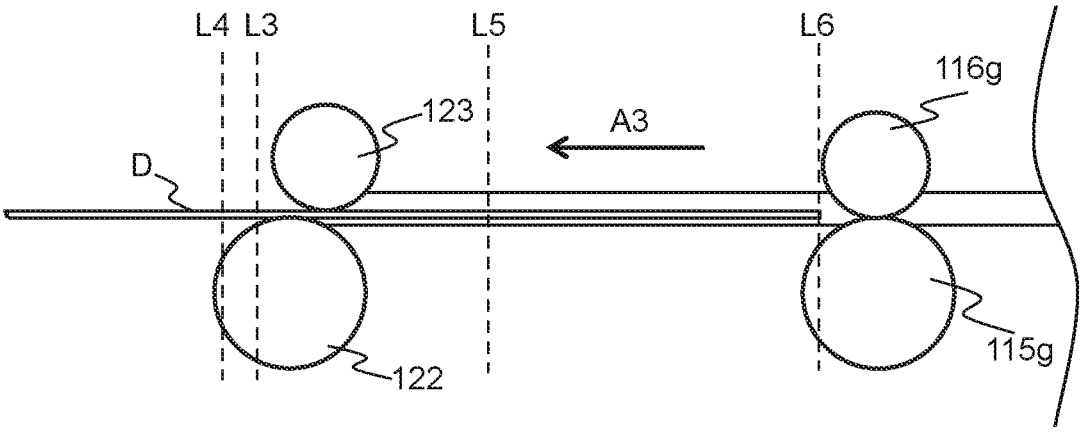
FIG. 12 is a schematic view for explaining a third predetermined timing.

FIG. 12 is a schematic view for explaining the third predetermined timing.

FIG. 12 illustrates a state at the third predetermined timing. In the example illustrated in FIG. 12, the third predetermined timing is set to the timing at which the rear edge of the medium reaches a position L6 between the seventh conveyance roller 115*g* and the predetermined position L5 corresponding to the second predetermined timing. In the state at the third predetermined timing, the rotation speed of the lower ejection roller 122 is set to the third speed, and the lower ejection roller 122 is accelerated.

As described above, the timing to reaccelerate the lower ejection roller 122 when the size of the medium is less than the threshold is set later than that to reaccelerate the lower ejection roller 122 when the size of the medium is equal to or larger than the threshold. For this reason, the leading edge of a medium to be conveyed next may approach too much the rear edge of a medium having a size less than the threshold. The control module 151 can prevent the leading edge of a medium to be conveyed next from approaching too much the rear edge of a medium having a size less than the threshold, by raising the conveyance speed of the medium during the period from the third predetermined timing to the second predetermined timing, when the size of the medium is less than the threshold.

The third predetermined timing is preferably set so that the rear edge of a medium having a size less than the threshold is ahead of the rear edge of a medium having a size equal to or larger than the threshold during the period from the third predetermined timing to the second predetermined timing, by an amount corresponding to delay in ejection. Hence, the control module 151 can ensure a distance between media, when the size of the medium is less than the threshold, equal to that between media when the size of the medium is equal to or larger than the threshold.

The third predetermined timing is set to a timing after the rear edge of the medium D passes through the seventh conveyance roller 115*g* placed closest to the lower ejection roller 122 among the first to seventh conveyance rollers 115*a* to 115*g*. At the third timing, since the medium D is not conveyed by the first to seventh conveyance rollers 115*a* to 115*g*, the medium ejection apparatus 100 can accelerate the lower ejection roller 122 without being hampered by the first to seventh conveyance rollers 115*a* to 115*g*.

As described in detail above, even in performing medium ejection processing in accordance with the flowchart illustrated in FIG. 11, the medium ejection apparatus can eject media to more suitably align the positions of the media ejected onto the ejection tray 104.

Figure 13:
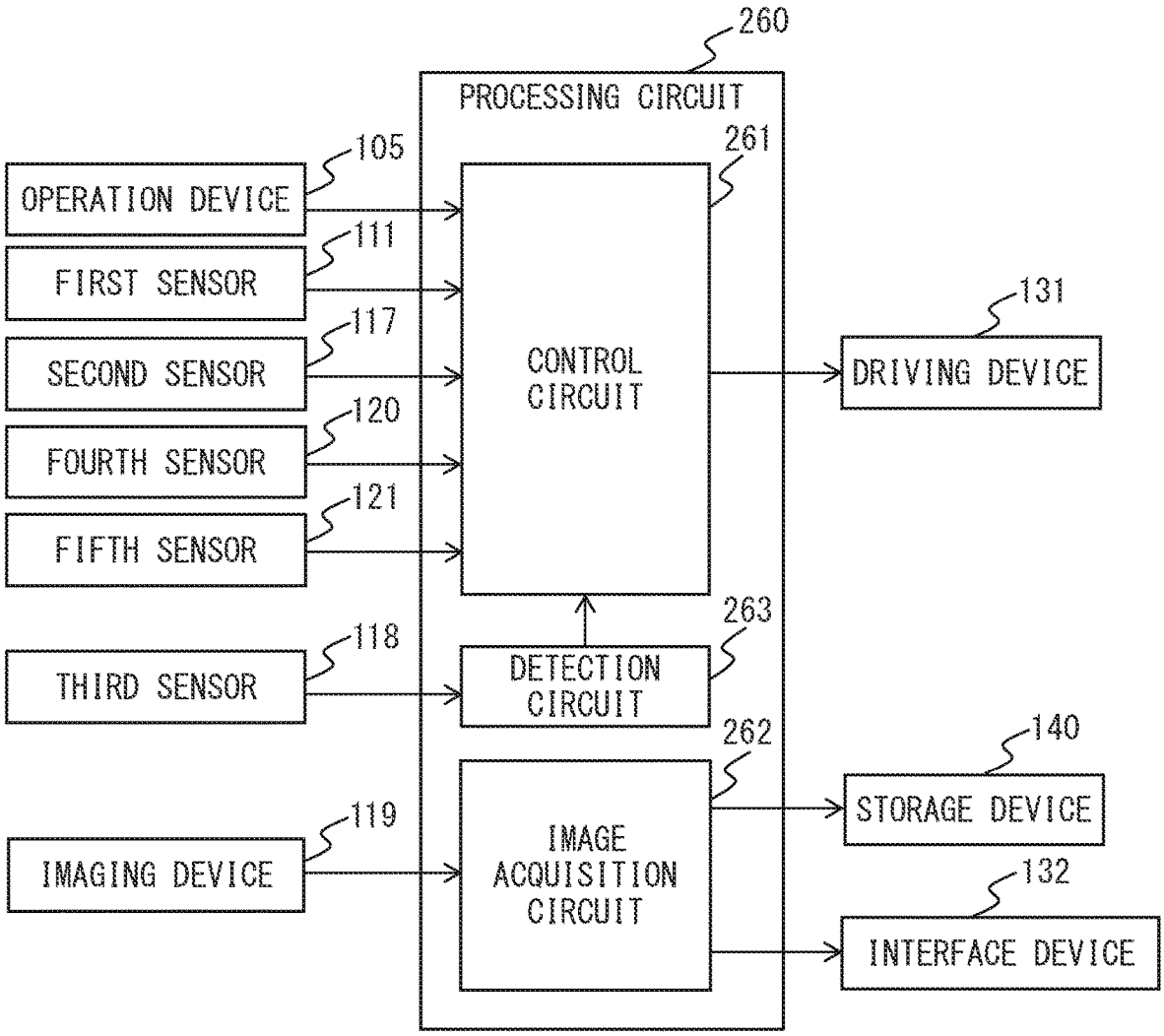
FIG. 13 is a diagram illustrating the schematic configuration of a processing circuit 260 according to another embodiment.

FIG. 13 is a diagram illustrating the schematic configuration of a processing circuit 260 of a medium ejection apparatus according to still another embodiment.

The processing circuit 260 is used in place of the processing circuit 160 of the medium ejection apparatus 100 to perform medium reading processing in place of the CPU 150. The processing circuit 260 includes, e.g., a control circuit 261, an image acquisition circuit 262, and a detection circuit 263. Each of these modules may be implemented as, e.g., an independent integrated circuit, microprocessor, or firmware.

The control circuit 261 is an example of a control module and has the same function as the control module 151. The control circuit 261 receives an operation signal from the operation device 105, respective detection signals from the first sensor 111, the second sensor 117, the fourth sensor 120, and the fifth sensor 121, and the size of a medium from the detection circuit 263. The control circuit 261 controls the driving device 131, based on each type of received information, and changes the predetermined timing to increase the rotation speed of the lower ejection roller 122 in accordance with the size of the medium.

The image acquisition circuit 262 is an example of an image acquisition module and has the same function as the image acquisition module 152. The image acquisition circuit 262 receives an input image from the imaging device 119, and stores the received input image in the storage device 140 or outputs it to the interface device 132.

The detection circuit 263 is an example of a detection module and has the same function as the detection module 153. The detection circuit 263 receives a third detection signal from the third sensor 118, detects the size of the medium, based on the third detection signal, and outputs it to the control circuit 261.

As described in detail above, even in performing medium ejection processing by the processing circuit 260, the medium ejection apparatus can eject media to more suitably align the positions of the media ejected onto the ejection tray 104.

The medium ejection apparatus may set the predetermined timing when the size of the medium is equal to or larger than a certain size to a timing later than the predetermined timing when the size of the medium is less than the certain size. For example, when the size of the medium in the medium ejection direction A3 is larger than the distance from a medium outlet to a stopper (not illustrated) provided on the ejection tray 104, the medium ejection apparatus may prolong the deceleration period of the lower ejection roller 122. This restrains the leading edge of the medium from strongly colliding with the stopper and the medium from being damaged.

According to this embodiment, the medium ejection apparatus, the control method, and the computer-readable, non-transitory medium storing the computer program can eject media to more suitably align the positions of the media ejected onto an ejection tray.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that the various changes, substitutions, and alterations could be made hereto without departing from the spirit and scope of the invention.

The invention claimed is:

1. A medium ejection apparatus comprising:

an ejection roller pair configured to eject a medium;

a driving device configured to rotate at least one roller of the ejection roller pair;

a processor for detecting a size of the medium, and controlling the driving device to increase a rotation speed of the at least one roller to be higher than a previous rotation speed, at a predetermined timing after a rear edge of the medium passes through a nip position of the ejection roller pair, wherein the processor changes the predetermined timing in accordance with the size of the medium.

2. The medium ejection apparatus according to claim 1, wherein the ejection roller pair includes an upper roller and a lower roller, and an end of the lower roller on a downstream side in a medium ejection direction is located on a downstream side, in the medium ejection direction, of an end of the upper roller on the downstream side in the medium ejection direction.

3. The medium ejection apparatus according to claim 1, wherein the processor sets the predetermined timing when the size of the medium is less than a threshold to a timing later than the predetermined timing when the size of the medium is not less than the threshold.

4. The medium ejection apparatus according to claim 3, wherein the processor controls the driving device to reduce the rotation speed to be lower than a previous rotation speed, at a second predetermined timing before the rear edge of the medium passes through the nip position of the ejection roller pair.

5. The medium ejection apparatus according to claim 4, further comprising: a feed roller configured to feed a medium, wherein the processor stops feeding of a subsequent medium for a predetermined period when a size of the medium is less than the threshold.

6. The medium ejection apparatus according to claim 4, further comprising: a conveyance roller provided upstream of the ejection roller pair in a medium ejection direction and configured to convey the medium, wherein the processor controls the driving device to increase a rotation speed to be higher than the previous rotation speed, until the second predetermined timing comes after the rear edge of the medium passes through the conveyance roller, when a size of the medium is less than the threshold.

7. A control method for a medium ejection apparatus including an ejection roller pair configured to eject a medium, and a driving device configured to rotate at least one roller of the ejection roller pair, the method comprising:

detecting a size of the medium;

controlling the driving device to increase a rotation speed of the at least one roller to be higher than a previous rotation speed, at a predetermined timing after a rear edge of the medium passes through a nip position of the ejection roller pair; and changing the predetermined timing in accordance with the size of the medium.

8. A computer-readable, non-transitory medium storing a computer program, wherein the computer program causes a medium ejection apparatus including an ejection roller pair configured to eject a medium, and a driving device configured to rotate at least one roller of the ejection roller pair, to execute a process, the process comprising:

detecting a size of the medium;

controlling the driving device to increase a rotation speed of the at least one roller to be higher than a previous rotation speed, at a predetermined timing after a rear edge of the medium passes through a nip position of the ejection roller pair; and changing the predetermined timing in accordance with the size of the medium.

* * * * *